US005581846A

United States Patent [19]

Wang

[11] Patent Number: 5,581,846

[45] Date of Patent: Dec. 10, 1996

[54] CONTROLLING HANDLE STRUCTURE FOR PULL RODS OF A LUGGAGE

[76] Inventor: Chien-Shan Wang, No. 80, Tien Hsin Li, Yuan Li Chen, Miao Li Hsien, Taiwan

[21] Appl. No.: 431,744

[22] Filed: May 1, 1995

[51] Int. Cl.[6] ..... B25G 1/04

[52] U.S. Cl. ..... 16/115; 190/18 A

[58] Field of Search ..... 16/115, 111 R, 16/DIG. 38; 280/47.315, 655, 655.1, 47.371; 190/14, 15 R, 104, 18 R, 18 A

[56] References Cited

U.S. PATENT DOCUMENTS

| | | | |
|---|---|---|---|
| 4,256,320 | 3/1981 | Hager | 190/18 A |
| 5,351,984 | 10/1994 | Cheng | 280/655 |
| 5,379,486 | 1/1995 | Wang | 16/115 |
| 5,458,020 | 10/1995 | Wang | 280/655 |

*Primary Examiner*—Chuck Y. Mah
*Attorney, Agent, or Firm*—Bacon & Thomas

[57] ABSTRACT

A controlling handle structure for pull rods of a luggage, including a handle member having a receptacle, a lower base received in the receptacle of the handle member and having a chamber and a controlling mechanism received in the chamber of the lower base. The controlling mechanism includes a first linking arm which is connected with a press button at one end and has an engaging section at the other end, and a second linking arm having an engaging section opposite to and engaged with the engaging section of the first linking arm, wherein the press button is depressably received in the through hole of the handle member to pivotally drive the first linking arm which reversely pivotally drives the second linking arm, whereby locking members disposed below the first and second linking arms are simultaneously moved to lock the pull rods.

1 Claim, 4 Drawing Sheets

CONTROLLING HANDLE STRUCTURE FOR PULL RODS OF A LUGGAGE

BACKGROUND OF THE INVENTION

The present invention relates to a controlling handle structure for pull rods of a luggage, and more particularly to a controlling handle structure which enables a user to easily simultaneously lock/unlock the pull rods on both sides of the luggage by one pressing movement.

Taiwanese Utility Model Application No. 82210282 (Publication No. 227101) discloses an improved pull rod structure of a luggage. In such pull rod structure, several shortcomings existing in the conventional device have been eliminated. However, there are still some problems existing in such pull rod structure. Especially, for example, as shown in FIG. 1, a clearance is defined between an inner tube 11 and an outer tube 12 so that when a handle A of the pull rod structure 1 is pulled upward and pushed downward, the inner tube 11 will be biased against the outer tube 12. Therefore, after a long period of use, the clearance between the inner and outer tubes 11, 12 will be enlarged to make the pull rod structure unable to be reliably locked.

SUMMARY OF THE INVENTION

It is therefore a primary object of the present invention to provide a controlling handle structure for pull rods of a luggage, which includes a handle member, a lower base received in the handle member and a controlling mechanism received in the lower base. The controlling mechanism includes a first linking arm and a second linking arm drivingly engaged with the first linking arm, whereby a user can depress a press button received in a through hole of the handle member to pivotally drive the first linking arm which reversely pivotally drives the second linking arm, so as to simultaneously move two locking members disposed below the linking arms to lock the pull rods on both sides of the luggage.

The present invention can be best understood through the following description and accompanying drawings, wherein:

DETAILED DESCRIPTION OF THE PREFERRED EMBODIMENT

Figure 1:
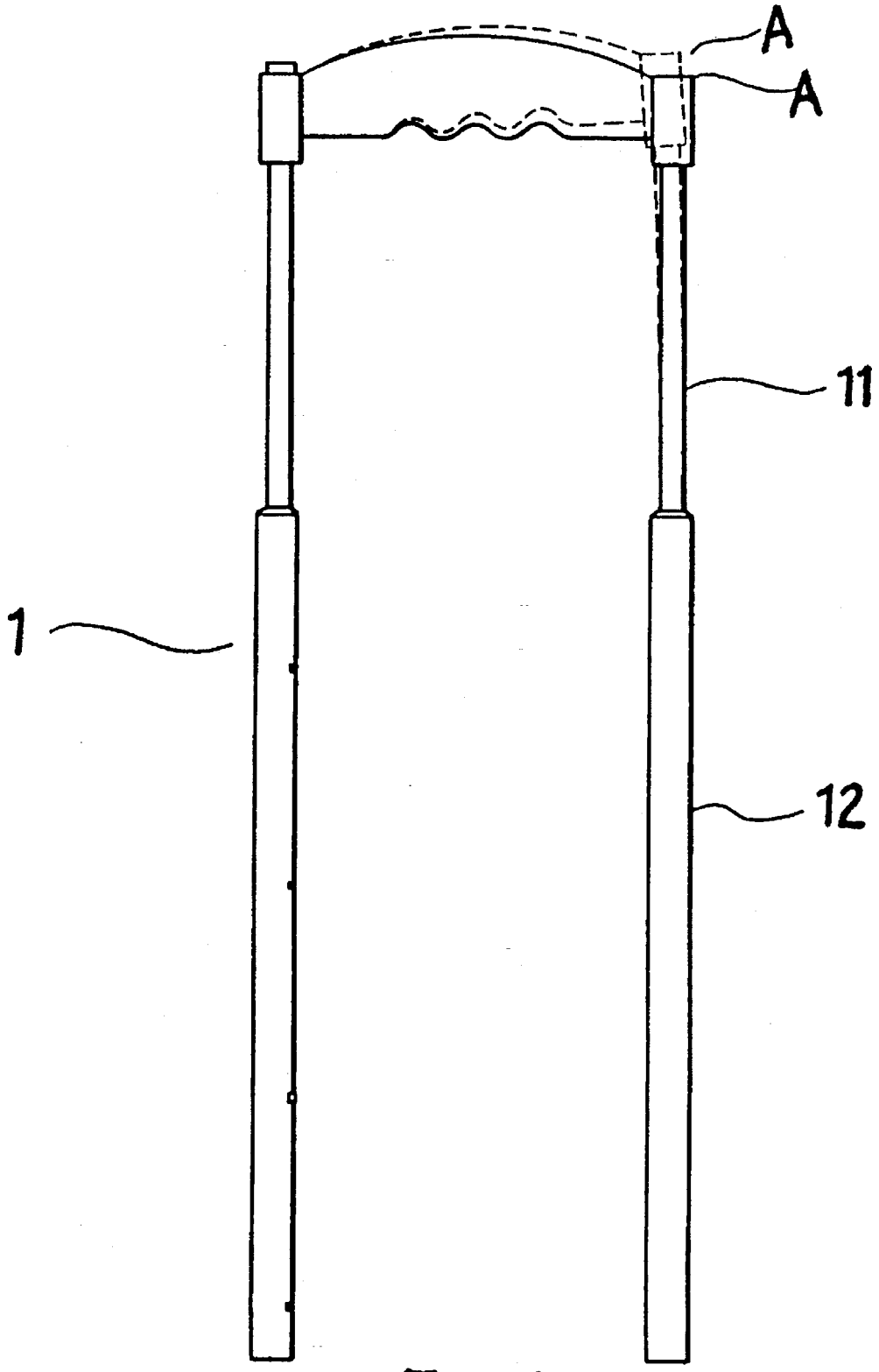
Fig 1 PRIOR ART
FIG. 1 is a front view of a conventional pull rod structure of a luggage, showing that the inner tube is biased against the outer tube when pulled and pushed.
Figure 2:
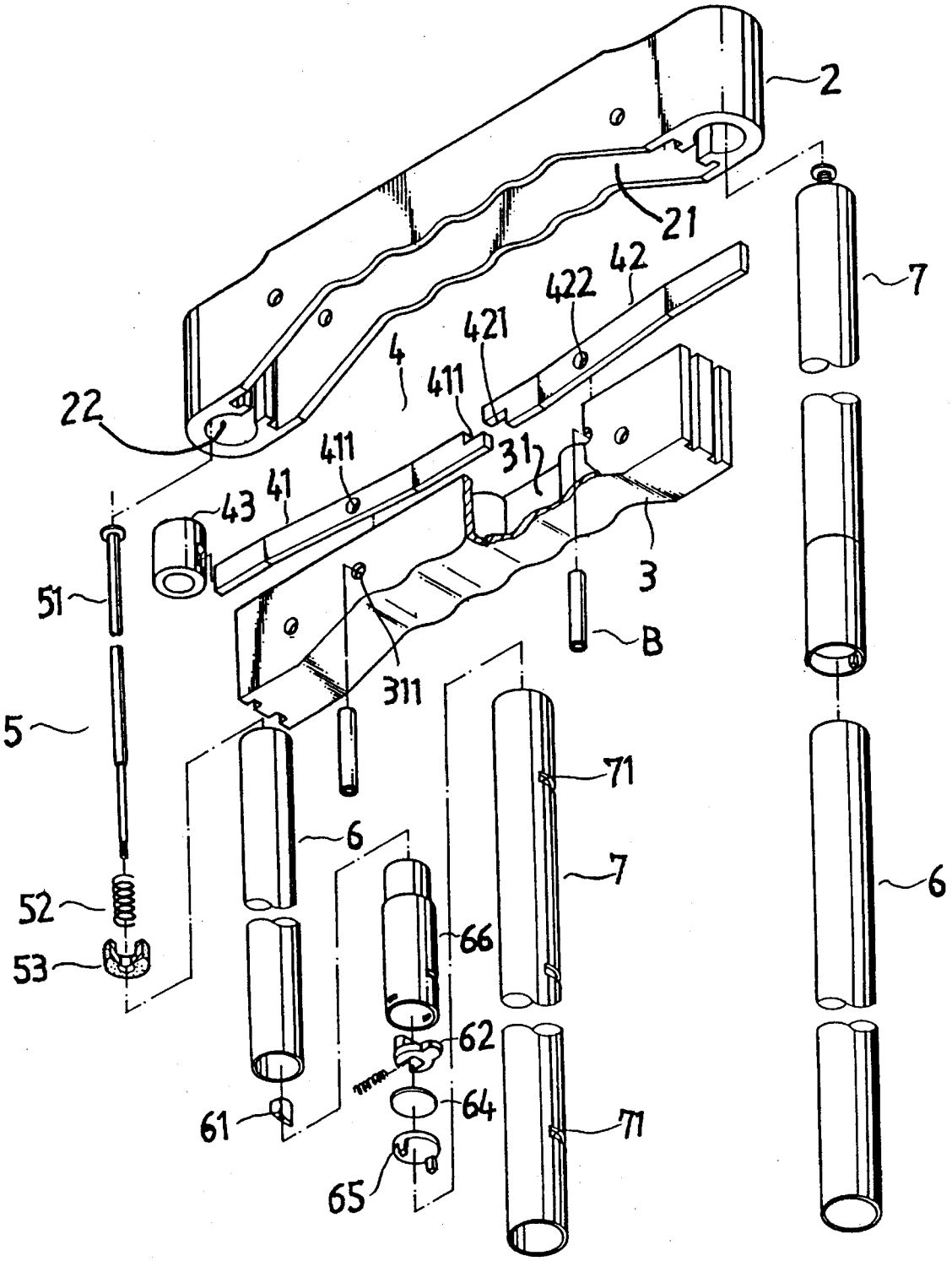
FIG. 2 is a perspective exploded view of the present invention.

Please refer to FIG. 2. The present invention mainly includes a handle member 2, a lower base 3, a controlling mechanism 4, a pair of rod means 5, a pair of driving means 6 and a pair of locating sleeves 7. Each of the rod means 5 includes a rod member 51, a compression spring 52 and a fixing seat 53 for the spring 52. Each of the locating sleeves 7 is formed with several locating holes 71. Each of the driving means 6 includes a triangular pushing block 61, a locking member 62, an extension spring 63, a pad member 64, a fixing sleeve 66 and a fixing plate 65.

The handle member 2 is formed with a receptacle 21, a lateral through hole 22 and apertures. The lower base 3 is formed with a chamber 31 and apertures 311.

The controlling mechanism 4 is disposed in the chamber 31 of the lower base 3, including a first linking arm 41 which is connected with a press button 43 at one end and has an engaging section 411 at the other end, and a second linking arm 42 having an engaging section 421 opposite to and engaged with the engaging section 411 of the first linking arm 41. The first and second linking arms 41, 42 are formed with through holes 412, 422, whereby rivets B can be passed through the apertures of the handle member 2, apertures 311 of the lower base 3 and the through holes 411, 422 of the linking arms 41, 42 to pivotably connect the same with the handle member 2 and the lower base 3.

Figure 3:
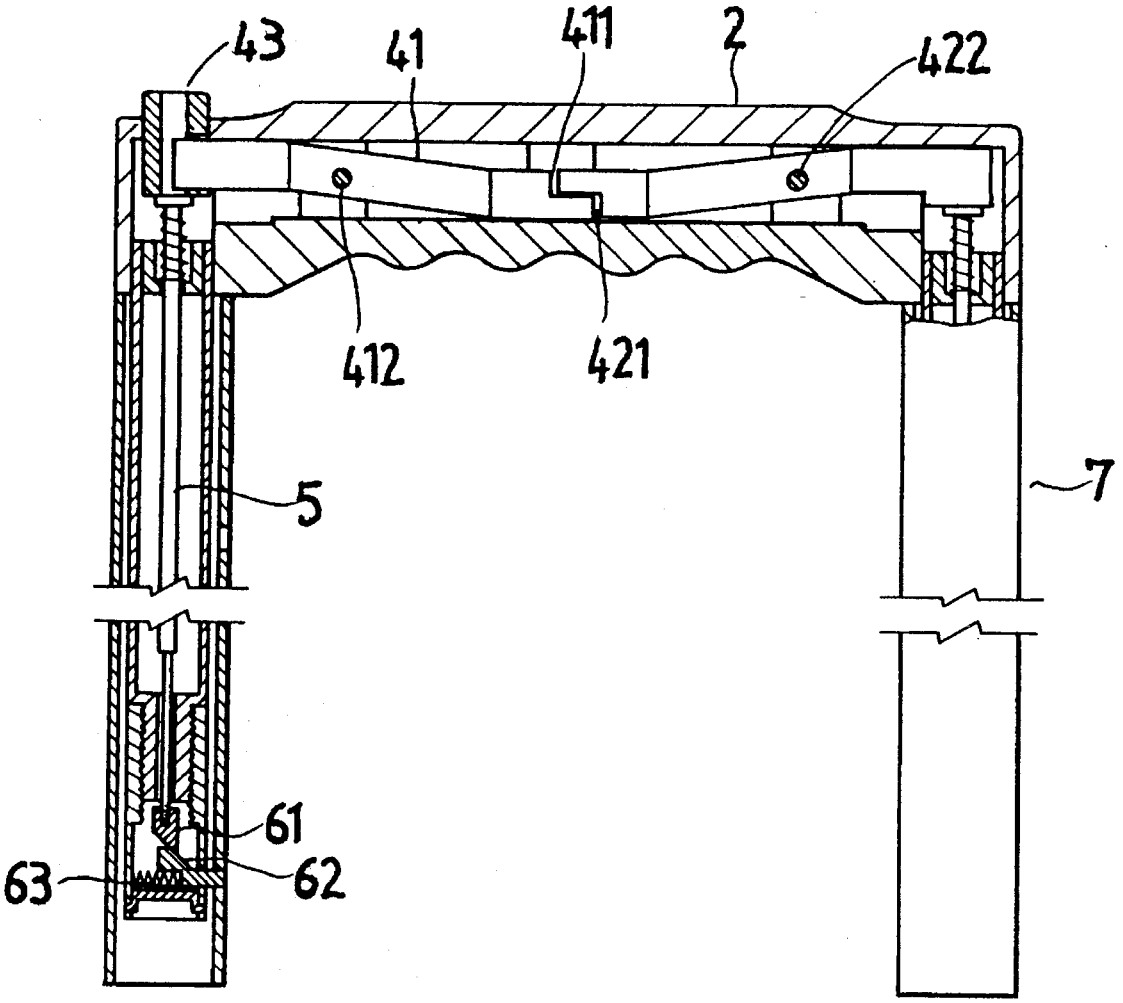
FIG. 3 is a sectional view showing that the press button is not pressed down.

Please refer to FIG. 3. When assembled, the controlling mechanism 4 and the lower base 3 are fitted into the receptacle 21 of the handle member 2 with the press button 43 extending through the through hole 22 of the handle member 2. Also, the press button 43 and a lower face of the second linking arm 42 abut against top ends of the rod members 51 received in the locating sleeves 7. The lower end of the rod members 51 are connected with the pushing blocks 61, locking members 62 and the extension springs 63.

Figure 4:
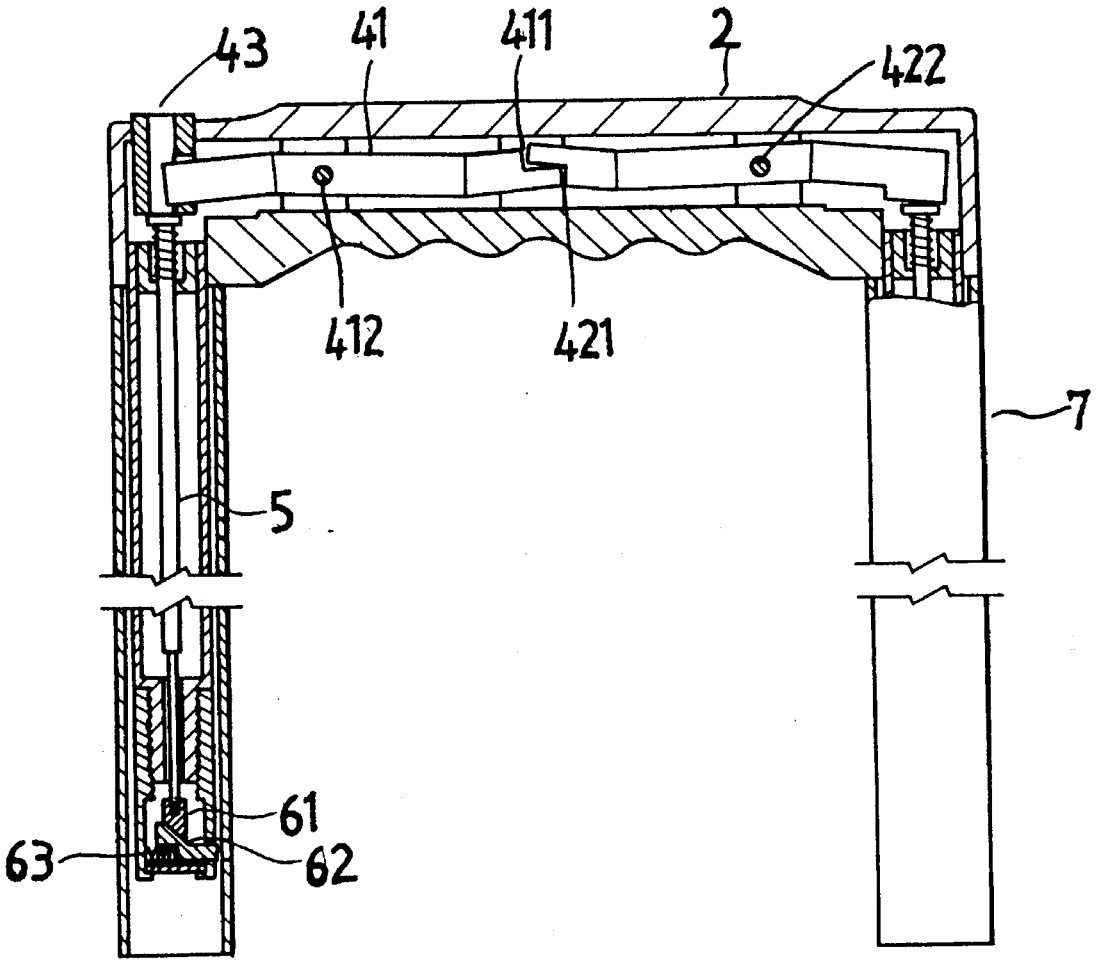
FIG. 4 is a sectional view showing that the press button is pressed down.

Please refer to FIG. 4. When the press button 43 is pressed down, the first linking arm 41 is pivoted about the rivet B and through the engaging sections 411, 421, the second linking arm 42 is driven and reversely pivoted, whereby the driving means 6 are moved downward with the pushing blocks 61 pushing the locking members 62 outward from the locating holes of the locating sleeves 7. Reversely, when the press button 43 is released, the compression spring 53 restores the press button 63 as well as the pushing blocks 61 to their home positions and the extension springs 63 restores the locking members 62 to their original locking positions as shown in FIG. 3.

The above embodiment is only an example of the present invention and the scope of the present invention should not be limited to the example. Any modification or variation derived from the example should fall within the scope of the present invention.

What is claimed is:

1. A controlling handle structure for pull rods of a luggage, comprising;

a handle member having a receptacle and a through hole; a lower base received in the receptacle of the handle member and having a chamber; a controlling mechanism received in the chamber of the lower base, said controlling mechanism including a first linking arm connected with a press button at a first end and having a first engaging section at a second end, and a second linking arm having a second engaging section opposite to and engaged with the first engaging section of the first linking arm, wherein the press button is depressably received in the through hole of the handle member; a pair of locating sleeves;

a pair of driving tubes slidably located in the pair of locating sleeves; a locking device on each of the driving tubes engagable with the associated locating sleeve to releasably lock the driving tubes and locating sleeves together; and a rod means located in each driving tube connected with the locking device and the controlling mechanism, whereby movement of the press button pivotally drives the first linking arm which reversely pivotally drives the second linking arm, causing the rod means to release the locking devices allowing the driving tubes to move relative to the locating sleeves.

* * * * *